US010330407B2

(12) United States Patent
Iwasawa

(10) Patent No.: US 10,330,407 B2
(45) Date of Patent: Jun. 25, 2019

(54) BOLT STOP BUFFER DEVICE IN GUN

(71) Applicant: TOKYO MARUI CO,LTD., Tokyo (JP)

(72) Inventor: Iwao Iwasawa, Tokyo (JP)

(73) Assignee: TOKYO MARUI CO, LTD., Tokyo (JP)

( * ) Notice: Subject to any disclaimer, the term of this patent is extended or adjusted under 35 U.S.C. 154(b) by 0 days.

(21) Appl. No.: 15/768,559

(22) PCT Filed: Oct. 16, 2015

(86) PCT No.: PCT/JP2015/079289
§ 371 (c)(1),
(2) Date: Apr. 16, 2018

(87) PCT Pub. No.: WO2017/064806
PCT Pub. Date: Apr. 20, 2017

(65) Prior Publication Data
US 2018/0313619 A1 Nov. 1, 2018

(51) Int. Cl.

| | |
|---|---|
| ***F41A 3/26*** | (2006.01) |
| ***F41C 23/04*** | (2006.01) |
| ***F41A 3/68*** | (2006.01) |
| ***F41A 3/42*** | (2006.01) |
| ***F41A 9/62*** | (2006.01) |

(Continued)

(52) U.S. Cl.
CPC *F41A 3/68* (2013.01); *F41A 3/42* (2013.01); *F41A 9/62* (2013.01); *F41A 17/36* (2013.01); *F41A 17/40* (2013.01)

(58) Field of Classification Search
CPC .... F41A 17/36; F41A 3/26; F41A 3/68; F41A 5/18; F41C 23/04
USPC ..... 42/16, 14; 89/198, 191.01, 132
See application file for complete search history.

(56) References Cited

U.S. PATENT DOCUMENTS 3,566,744 A * 3/1971 Stoner ..... F41A 3/78 42/25
3,748,959 A * 7/1973 Moller ..... F41A 3/82 89/132

(Continued)

FOREIGN PATENT DOCUMENTS

JP 2000-508051 6/2000
JP 2010-025501 2/2010

OTHER PUBLICATIONS

"International Search Report (Form PCT/ISA/210)" of PCT/JP2015/079289, dated Jan. 12, 2016, with English translation thereof, pp. 1-3.

*Primary Examiner* — Michael D David
(74) *Attorney, Agent, or Firm* — JCIPRNET

(57) ABSTRACT

A gun includes a bolt member that is disposed in a gun body so as to be movable forward and rearward, that moves rearward in response to gas pressure generated by bullet shooting so as to compress a bolt spring, and that moves forward in response to release of the compressed pressure so as to perform a bullet loading operation, and a bolt stop that stops forward movement of the bolt member. The bolt stop (31) has engagement means (36) for engaging with the bolt member which moves forward to reach the engagement means (36) after last bullet shooting, and includes buffer means (40) for buffering an impact force applied to the bolt stop due to the engagement so as to act on the bolt stop.

6 Claims, 5 Drawing Sheets

(51) Int. Cl.
*F41A 17/36* (2006.01)
*F41A 17/40* (2006.01)

(56) References Cited

U.S. PATENT DOCUMENTS 3,757,636 A * 9/1973 Chiabrandy ..... F41A 3/82 89/169
4,240,324 A * 12/1980 Smith ..... F41A 5/02 89/132
4,269,108 A * 5/1981 Stoner ..... F41A 15/14 42/25
4,398,448 A * 8/1983 LaFever ..... F41A 3/26 89/185
5,052,138 A * 10/1991 Crain ..... F41A 9/62 42/1.02
6,848,351 B1 * 2/2005 Davies ..... F41A 3/94 89/191.01
7,261,029 B1 8/2007 Davis
7,584,691 B2 * 9/2009 Steimke ..... F41A 3/26 42/16
7,975,595 B2 * 7/2011 Robinson ..... F41A 3/26 89/185
8,210,090 B2 * 7/2012 Brown ..... F41A 29/00 89/193
8,359,966 B1 1/2013 Brotherton
8,381,628 B1 * 2/2013 Wheatley ..... F41A 35/06 42/43
8,393,107 B2 * 3/2013 Brown ..... F41C 7/00 42/105
8,991,088 B1 * 3/2015 Young ..... F41A 25/00 42/75.03
9,103,611 B2 * 8/2015 Neitzling ..... F41A 3/26
2005/0183310 A1 8/2005 Finn
2010/0275485 A1 11/2010 Findlay
2012/0144712 A1 * 6/2012 Rostocil ..... F41A 9/79 42/16
2013/0014416 A1 1/2013 Sisgold
2015/0198400 A1 7/2015 O'Dell
2015/0345895 A1 * 12/2015 Young ..... F41A 11/04 42/71.01
2017/0328665 A1 * 11/2017 Bailey ..... F41A 21/10
2018/0112942 A1 * 4/2018 Iwasawa ..... F41A 5/34
2018/0120049 A1 * 5/2018 Iwasawa ..... F41B 11/643
2018/0128568 A1 * 5/2018 Iwasawa ..... F41B 11/70

* cited by examiner

BOLT STOP BUFFER DEVICE IN GUN

CROSS-REFERENCE TO RELATED APPLICATION

This application is a 371 application of the International PCT application serial no. PCT/JP2015/079289, filed on Oct. 16, 2015. The entirety of each of the above-mentioned patent applications is hereby incorporated by reference herein and made a part of this specification.

TECHNICAL FIELD

The present invention relates to a bolt stop buffer device in a gun including a bolt member which is disposed in a gun body so as to be movable forward and rearward, which moves rearward in response to gas pressure generated by bullet shooting so as to compress a bolt spring, and which moves forward in response to release of the compressed pressure so as to perform bullet loading, and a bolt stop which stops forward movement of the bolt member.

BACKGROUND ART

The bolt stop is disposed in many guns having a bolt which compresses a spring (simply, referred to as the bolt spring in this document) acting on the bolt in response to a gun operation, and which moves forward in response to the released pressure. An automatic loading firearm which is so-called assault rifle includes this mechanism. In this type of gun, the bolt moves forward so as to load a bullet. After last bullet shooting, the bolt stops by colliding with the bolt stop in order to notify a user that the bullets are all shot. This operation of collision and stop is repeatedly performed every time the bullets are all shot.

Therefore, every time the bolt collides with the bolt stop, a strong impact is applied to the bolt stop. Consequently, metal fatigue is likely to occur, thereby causing damage to the bolt stop in the worst case. In a case of a real gun, this problem has been pointed out for a long time. However, at the present time, no idea can be found about what kind of remedial measures has to be planned. That is, it is not possible to find a recognizable gun in which damage prevention measures are planned for the bolt stop.

Even if the related art is examined, an intended result cannot be obtained. For example, through a text search site of the Japanese Patent Office, only 3 search results are obtained by using the bolt stop as a keyword. One of the results relates to an internal combustion engine, and the other two results are also irrelevant to an aspect of the bolt stop which is an object of the present invention. Japanese Unexamined Patent Application Publication No. 2010-025501 discloses an invention of a mechanical power supply stop device in an electric gun according to an application of the present applicant, and the bolt stop is referred to in the description. However, the disclosed electric gun imitates a real gun as a component. In fact, the disclosed electric gun only has a reset function. The other remaining one result in PCT Japanese Translation Patent Publication No. 2000-508051 discloses an invention relating to a bolt firing pin locking device of a firearm. In the description with reference to FIG. 2, there is a phrase such as "a bolt 14 can move rearward as far as a slight distance until a stop wall 25W comes into contact with a bolt stop surface 31*f*", and a phrase such as "the bolt 14 is pressed against a bullet C by a large reaction spring (not illustrated) linked to the bolt 14 via a circular column 35" is described at the end of the sentence.

However, these phrases in the description indicate that the impact applied to the bolt stop by the bolt is not an issue.

Furthermore, after US Patent Publications are examined by using the bolt stop as the keyword through a site of the US Patent and Trademark Office, approximately 10 results are obtained. Among these results, two inventions relating to the bolt stop of the firearm are found. In the two inventions, US2010/0275485A1 discloses an invention relating to the bolt stop employing a both-handed type so that the bolt stop can be used for a left-handed person, similarly to a right-handed person. In addition, US2005/0183310A1 discloses an invention in which a magazine is attached and detached in association with the bolt stop. Both of these do not disclose that the impact of the bolt is regarded as a problem.

CITATION LIST

Patent Literature

[PTL 1] Japanese Unexamined Patent Application Publication No. 2010-025501

[PTL 2] PCT Japanese Translation Patent Publication No. 2000-508051

[PTL 3] US2010/0275485A1

[PTL 4] US2005/0183310A1

SUMMARY OF INVENTION

Technical Problem

The present invention is made in view of the above-described circumstances, and an object thereof is to provide a bolt stop buffer device in a gun which is unlikely to be damaged and which ensures improved durability by buffering impacts of a bolt member, even if the impacts are repeatedly applied to a bolt stop. In addition, another object of the present invention is to detect that bullets are completely shot, to disengage the bolt stop from the bolt member when a magazine is replaced and reloaded, and to detect bullet absence in response to the disengagement. According to the present invention, while a function to replace and reload the magazine is maintained, it is possible to absorb the impacts applied by forward movement of the bolt member.

Solution to Problem

According to the present invention, in order to solve the above-described problem, there is provided a gun including a bolt member that is disposed in a gun body so as to be movable forward and rearward, that moves rearward in response to gas pressure generated by bullet shooting so as to compress a bolt spring, and that moves forward in response to release of the compressed pressure so as to perform a bullet loading operation, and a bolt stop that stops forward movement of the bolt member. The bolt stop has engagement means for engaging with the bolt member which moves forward to reach the engagement means after last bullet shooting, and includes buffer means for buffering an impact force applied to the bolt stop due to the engagement so as to act on the bolt stop.

A target of the gun to which a bolt stop buffer device according to the present invention is applied is a gun which uses gas generated using explosive combustion caused by bullet shooting as a pressure source. A main purpose of the bolt member is as follows. The bolt member moves rearward in response to gas pressure. At that time, the bolt member performs a discharge operation for removing a cartridge from a bullet loading chamber, and a bullet loading operation for a bullet into the bullet loading chamber. More specifically, as an example, the bullet loading operation includes an operation for closing a gun chamber by converting forward movement of the bolt into rotational movement. In addition, the bolt stop holds the bolt member to stay at a rearward movement position, thereby notifying a user that a magazine is emptied. Accordingly, the user can quickly reload the magazine.

The bolt stop according to the present invention has a function to stop the bolt member which moves forward to reach the bolt stop after last bullet shooting. That is, the bolt stop has engagement means for engaging with the bolt member which moves forward to reach the engagement means after the last bullet shooting, and includes buffer means for buffering an impact force applied to the bolt stop due to the engagement so as to act on the bolt stop. In this case, as a minimum configuration requirement, the bolt stop includes the engagement means for engaging with the bolt member, and the buffer means acts on the bolt stop. If this requirement is satisfied, the present invention is established. Therefore, as a matter of course, other requirements can be added to the present invention. The bolt member moves rearward in response to the gas pressure generated by bullet shooting so as to compress the bolt spring, and moves forward in response to the release of the compressed pressure so as to perform a bullet loading operation. The bolt member causes the impact to be buffered.

In addition, the present invention preferably adopts the following configuration. The gun body has bullet absence detection means for detecting the presence or absence of a bullet to be supplied to a bullet loading unit in response to a gun operation. The bullet absence detection means detects bullet absence. In this manner, the bullet absence detection means includes a link mechanism which enables the engagement means to engage with the bolt member by causing the bolt stop configuring a bolt stop mechanism to protrude into a track when the bolt member moves forward and rearward.

The bolt stop may include the bolt stop mechanism that receives an impact of the bolt member which moves forward to reach the bolt stop mechanism and transmit the impact to the buffer means, between the bolt member and the buffer means. It is desirable that the buffer means includes an elastic member that is elastically deformed by the transmitted impact. According to this configuration, the elastic member is disposed in a rear stage of the bolt stop mechanism. However, the buffer means has only to act on the bolt stop. Accordingly, the above-described form is consistently applied to a case of using the bolt stop mechanism.

In addition, it is desirable to adopt a configuration as follows. The bolt stop configuring the bolt stop mechanism has a long hole in a forward-rearward direction where a shaft disposed on the gun body side is located, and is disposed so as to be movable in a range of the long hole and rotatable around the shaft. In addition, it is preferable to adopt the following configuration. The engagement means includes an engagement portion disposed in the bolt member and an engagement pair portion disposed in the bolt stop, and is disposed so as to configure an acute angle in a forward movement direction of the bolt member. According to this configuration, reliable engagement is expected. However, in a case where the above-described configuration of the acute angle is not appropriate, there is room for adopting a configuration of a right angle or an obtuse angle.

This type of gun includes a so-called gun dedicated to single shooting and a switching gun for repeated shooting and single shooting. However, the present invention is applicable to any one of both of these. In a case of the switching gun for repeated shooting and single shooting, if shooting is repeatedly performed, bullets decrease fast, and the magazine is frequently replaced. The frequency of impacts received by the bolt stop increases. Therefore, impact buffering according to the present invention is more effectively used.

Advantageous Effects of Invention

The present invention is configured and operated as described above. Accordingly, the impact of the bolt member which is applied to the bolt stop can be absorbed and buffered by the buffer means, and the bolt member can resist the repeated impacts. Accordingly, it is possible to provide the bolt stop buffer device in the gun which is unlikely to be damaged and which ensures improved durability. In addition, according to the present invention, the bolt stop member is disengaged from the bolt member when the magazine is replaced and reloaded after detecting that bullets are completely shot. In this manner, while a function to detect the bullet absence and to replace and reload the magazine is maintained, it is possible to absorb the impact applied by forward movement of the bolt member.

BRIEF DESCRIPTION OF DRAWINGS

FIG. 2A is a longitudinal sectional view for describing the main portion, and FIG. 2B is a sectional view taken along line IIB-IIB in FIG. 2A.

FIG. 3A is a longitudinal sectional view for describing a state before last bullet shooting, and FIG. 3B is a longitudinal sectional view for describing a state where a bolt member intermediately moves rearward after the last bullet shooting.

FIG. 4A is a sectional view for describing a state where the bolt member moves rearward to the maximum, and FIG. 4B is a sectional view for describing a state where the bolt member starts to move forward.

FIG. 5A is a sectional view for describing a state indicating a forward movement position of a bolt stop member, and FIG. 5B is a sectional view for describing a state where the bolt stop member is move rearward in a range of a long hole by a buffer spring.

DESCRIPTION OF EMBODIMENTS

Hereinafter, the present invention will be described in more detail with reference an illustrated embodiment. A bolt stop buffer device in a gun according to the present invention is applicable to various guns having a bolt stop which stops a bolt member. The illustrated embodiment relates to an assault rifle, and includes configurations which are indispensable for detailed description of the present invention.

Figure 1:
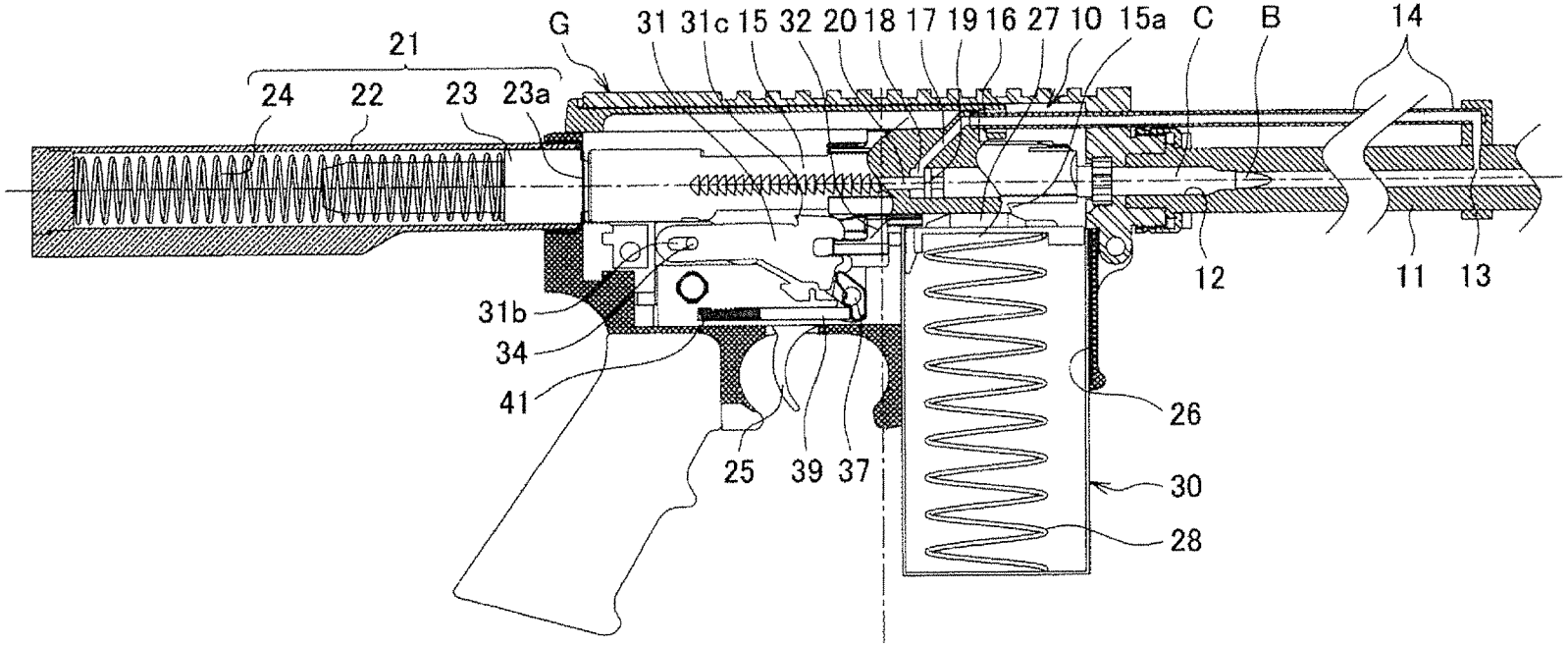
FIG. 1 is a longitudinal sectional view for describing an example of an assault rifle to which a bolt stop buffer device is applied in a gun according to the present invention.

A gun G illustrated in FIG. 1 includes a shooting device 10 for shooting a bullet in a gun body, and includes a barrel portion 11 disposed in a front portion of the shooting device 10, a movable body portion 21 for a blowback bolt carrier 15 which is disposed in a rear portion of the shooting device 10, and a magazine loading unit 26 disposed in a lower portion of the shooting device 10, respectively. A rear portion of the barrel portion 11 has a bullet loading chamber 12 in which a cartridge C having a bullet (warhead) B is loaded, and a front portion of the barrel portion 11 has an outlet 13 for removing gas generated by bullet shooting from the inside of the barrel. The bullet in a case where bullet loading is referred means a so-called ball cartridge (live cartridge) which is integrated with the cartridge C before shooting.

One end side of a gas tube 14 disposed outside the barrel is connected to the above-described outlet 13, and the other end side of the gas tube 14 extends rearward to reach the inside of the gun body. The gas tube 14 is disposed so as to be connectable to and detachable from a front end portion of a bolt carrier key 16 which is movable forward and rearward integrally with a bolt carrier 15. As described above, the bolt carrier 15 is disposed on the gun body side so as to be movable forward and rearward. The bolt carrier 15 moves rearward in response to gas pressure generated by bullet shooting so as to compress a bolt spring 24, and moves forward in response to release of the compressed pressure so as to perform a bullet loading operation.

The bolt carrier 15 has a longitudinally elongated and substantially rod-shaped form, and a bolt 20 is disposed in a shaft core portion of the rod-shaped form so as to be movable forward and rearward. The bolt carrier key 16 communicates via a duct 17 with a cylindrical bore 18 in which the bolt 20 moves forward and rearward. Gas generated by the bullet shooting is guided rearward of a piston-shaped pressure receiving portion 19 of the bolt 20 which slides inside the bore 18. A firing pin (firing pin, refer to FIG. 2A and FIG. 2B) 20*a* which hits a blasting cap of the cartridge C is incorporated in the shaft core portion of the bolt 20 so as to be movable forward and rearward. In the present embodiment, the bolt carrier 15 having the bolt 20 incorporated therein is called a bolt member. A structure of the bolt employs various types other than the illustrated structure. The present invention is applicable to any type of the gun, as long as the bolt moves rearward in response to the gas pressure generated by the bullet shooting so as to compress the bolt spring and moves forward in response to the release of the compressed pressure so as to perform the bullet loading operation.

A movable body portion 21 is disposed in the rear of the bolt carrier 15, and the movable body portion 21 has a casing 22 attached to the gun body and a movable shaft 23 disposed therein. The movable shaft 23 is disposed inside the casing 22 so as to be movable forward and rearward, and is configured to be connected to a rear end of the bolt carrier 15 in a shaft head 23 *a*. In the drawing, the reference numeral 24 represents a bolt spring, and the bolt spring 24 biases the movable shaft 23 in a forward movement direction, thereby finally bringing the bolt carrier 15 in a shooting preparation state. In addition, the bolt spring 24 functions as means for relaxing recoil shock by receiving the bolt carrier 15 during a rearward movement operation.

A trigger mechanism to be included in the gun according to the present invention is common to that of the assault rifle, and the operation is also the same as the general operation. Accordingly, a schematic configuration will be described below, and detailed description will be no longer continued. That is, a configuration is adopted as follows. The reference numeral 25 represents a trigger for the operation. Through the operation, a locked state of a hammer (not illustrated) is released, thereby hitting the above-described firing pin (firing pin) 20*a*. According to this configuration, the blasting cap of the bullet loaded in the bullet loading chamber 12 is hit, thereby leading to the bullet shooting.

A magazine 30 is located in a lower portion of the shooting device 10. The magazine 30 is detachably attached to the magazine loading unit 26 disposed in the lower portion of the gun body. The ball cartridge is supported by a follower 27 incorporated therein, and is pressed up to an empty space 29 (refer to FIG. 4A and FIG. 4B) in the rear of the bullet loading chamber illustrated in FIG. 4A and FIG. 4B and subsequent drawing by the follower spring 28.

Figure 2A:
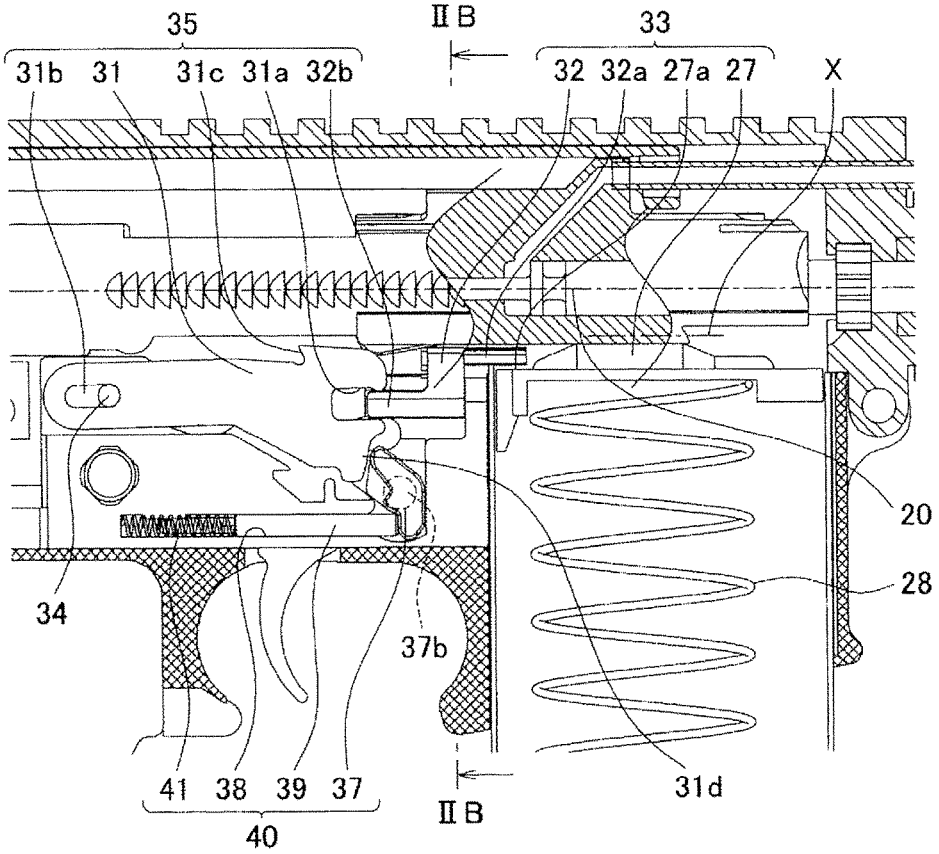
FIG. 2A and FIG. 2B are enlarged views illustrating a main portion of the device.
Figure 2B:
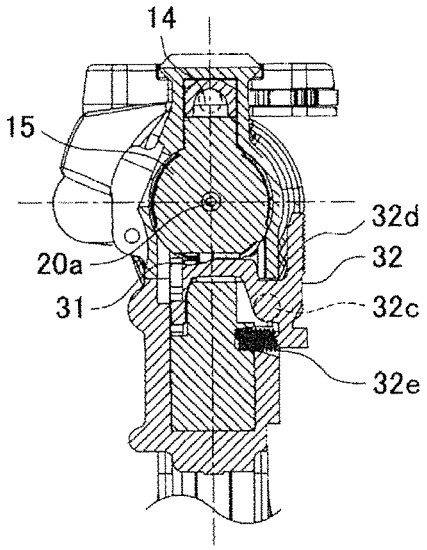

The bolt stop buffer device in the gun according to the present invention is illustrated in detail as an embodiment in FIG. 2A and FIG. 2B. The bolt stop buffer device according to the embodiment has a configuration including the bolt carrier 15 which is compressed by the gun operation so as to move forward in response to the release of the bolt spring 24, and the bolt stop 31 which stops the above-described forward moving bolt carrier 15. Particularly, the embodiment has a configuration in which the operation of the bullet absence detection means 33 causes the bolt stop 31 to protrude into a track X in which the bolt carrier 15 moves forward and rearward. The configuration is adopted so that the impact applied when the bolt carrier 15 moving forward and the bolt stop 31 collide with each other is absorbed using the buffer means 40.

The above-described follower 27 fulfills a role of detecting that the last bullet B is shot. That is, the follower 27 is installed inside the magazine 30, and rises as the follower spring 28 compressed by the bullet (ball cartridge) is stretched by a resilient force thereof. The follower 27 hits the lower side of the bolt carrier 15, and stops. Thereafter, if the bullet B is shot and the bolt carrier 15 moves rearward, the follower 27 rises. The follower 27 engages with a relay member 32 connected to the bolt stop 31 in a rear end portion 27*a*. Therefore, the follower 27 and the relay member 32 configure the bullet absence detection means 33.

A rear end portion 27*a* of the follower 27 engages with and presses up one end portion 32*a* in the relay member 32 with the bolt stop 31, and causes the bolt stop 31 to protrude into the track X in which the bolt carrier 15 moves forward and rearward. The follower 27 and the relay member 32 configure a link mechanism for allowing the bullet absence detection means 33 and the bolt stop 31 to communicate with each other.

The above-described relay member 32 engages with the bolt stop 31 configuring a bolt stop mechanism 35. That is, the other end portion 32*b* of the relay member 32 engages with the bolt stop 31 in a groove-shaped engagement portion 31*a*. Therefore, if bullet absence is detected by the bullet absence detection means 33, bullet absence information indicating that the bullets B to be loaded in the bullet loading chamber 12 are all shot is sequentially transmitted to the bolt stop 31 by the bullet absence detection means 33.

Referring to FIG. 2B, the relay member 32 is illustrated as a member extending to the left and right of the gun body. The relay member 32 is pivotally supported in the gun body by a shaft 32*c* disposed on the left side of the gun body, and is disposed so that a right side portion (crank-shaped portion in FIG. 2A and FIG. 2B) is movable upward and downward by the rotation around the shaft. In addition, the relay member 32 has an operation unit 32*d* appearing on the left side of the gun body in the upper portion of the shaft 32*c*. A spring 32*e* is operated in the lower portion thereof, thereby causing the relay member 32 to return to a fixed position. In this manner, the bolt stop 31 (to be described later) is pressed down.

A long hole 31*b* is formed in a forward-rearward direction of the bolt stop 31, and the bolt stop 31 is pivotally supported on the gun body side by the shaft 34 so as to be capable of oscillating. Therefore, the bolt stop 31 is movable as much as a stroke amount inside the long hole 31*b*, and is rotatable around the shaft 34. As a result of this configuration, the link mechanism causes the engagement pair portion 31*c* side of the bolt stop 31 to rise via the relay member 32, and enables the bolt stop 31 to protrude into the track X in which the bolt carrier 15 moves forward and rearward.

Figure 4A:
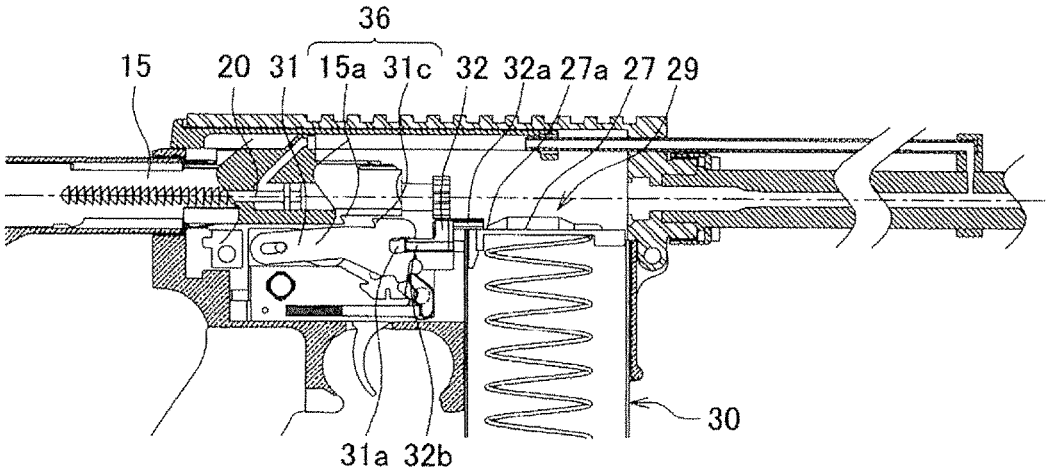
FIG. 4A and FIG. 4B also relate to an operation of the device.
Figure 4B:
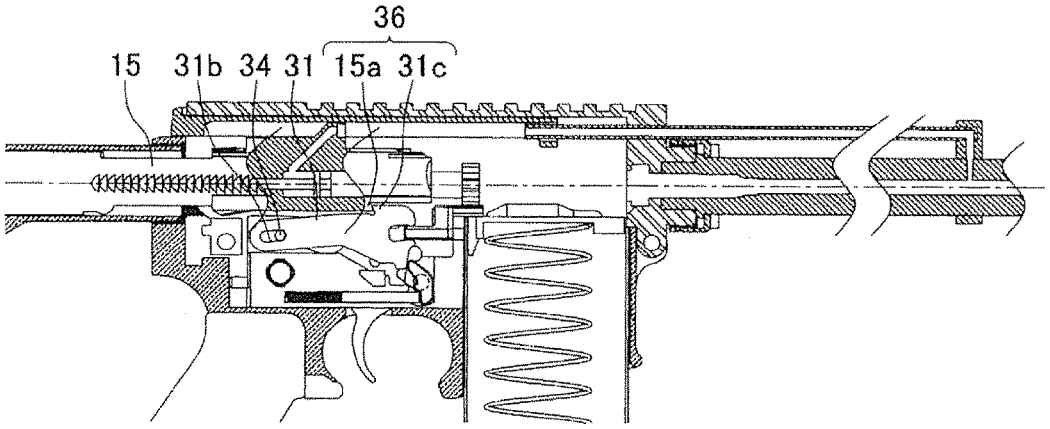

The bolt carrier 15 is disposed in the engagement portion 15*a* as one engagement means 36, and this engagement portion 15*a* is configured so as to be capable of engaging with an engagement pair portion 31*c* disposed in the above-described bolt stop 31 as the other engagement means 36 (refer to FIG. 4A and FIG. 4B). In particular, the engagement portion 15*a* and the engagement pair portion 31*c* according to the embodiment are disposed to serve as inclined portions configuring an acute angle in the forward movement direction of the bolt carrier 15. In a configuration in which the bolt stop 31 is pivotally supported by the shaft 34 in the long hole 31*b* in the forward-rearward direction, the inclination of the engagement portion 15*a* and the engagement pair portion 31*c* can eliminate unstable engagement which may occur in a case where the engagement portion 15*a* and the engagement pair portion 31*c* is set to form a right angle. Forming the engagement means 36 to have the acute angle in the forward movement direction is merely one means in this embodiment. If the conditions for the engagement between the bolt carrier 15 and the bolt stop 31, for example, mass, speed, and a material of the members involved in the engagement are different from each other, a form of using a right angle or an obtuse angle may be selected within a conceivable range.

The buffer means 40 acts on the bolt stop 31. The buffer means 40 according to the embodiment has a buffer link 37, a buffer shaft 39 incorporated in the buffer link 37 so as to be movable to an attachment portion 38 on the gun body side in the forward-rearward direction, and a buffer spring 41 which pressurizes the buffer shaft 39 forward. The above-described buffer link 37 is pivotally supported on the gun body side by the shaft 37*b* so as to be capable of oscillating. One end engages with a front engagement portion 31*d* of the bolt stop 31, and the other end engages with the tip of the buffer shaft 39. Accordingly, at the time of the collision caused by the forward movement of the bolt carrier 15, the impact applied by the bolt stop 31 moving in a gunpoint direction is transmitted to and absorbed by the buffer means 40.

The relay member 32 and the bolt stop 31 are arrayed side by side in a direction from the gunpoint toward the gunstock. Accordingly, when moving forward, the bolt carrier 15 collides with the bolt stop 31 of the bolt stop mechanism 35. However, the relay member 32 has a structure which does not come into contact with the bolt carrier 15, and has a structure which comes into contact with the bolt stop 31 even if the bolt stop 31 moves to the maximum. Accordingly, the relay member 32 does not come into direct contact with the relay member 32. The bolt stop 31 engages with the shaft 34 in the long hole 31*b*. Accordingly, the bolt stop 31 is movable in the maximum length range of the long hole 31*b*. When the bolt stop 31 moves to the maximum, the other end portion 32*b* of the relay member 32 is brought into a state of further entering a groove portion 31*a* of the bolt stop 31.

Figure 3A:
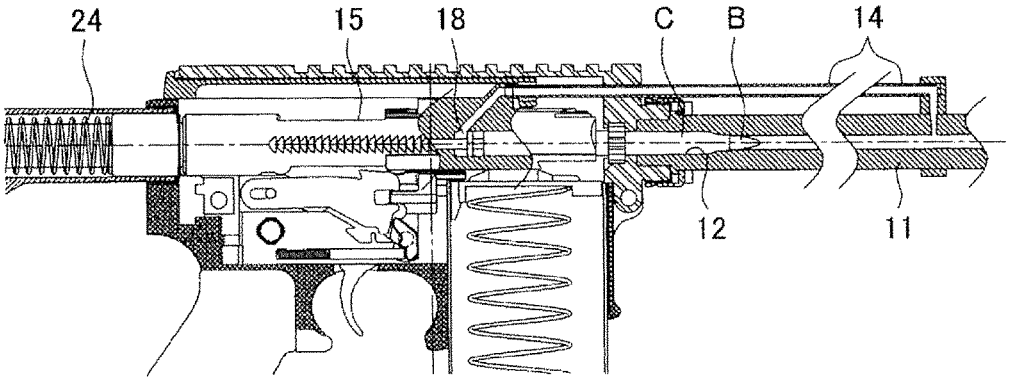
FIG. 3A and FIG. 3B relate to an operation of the device.
Figure 3B:
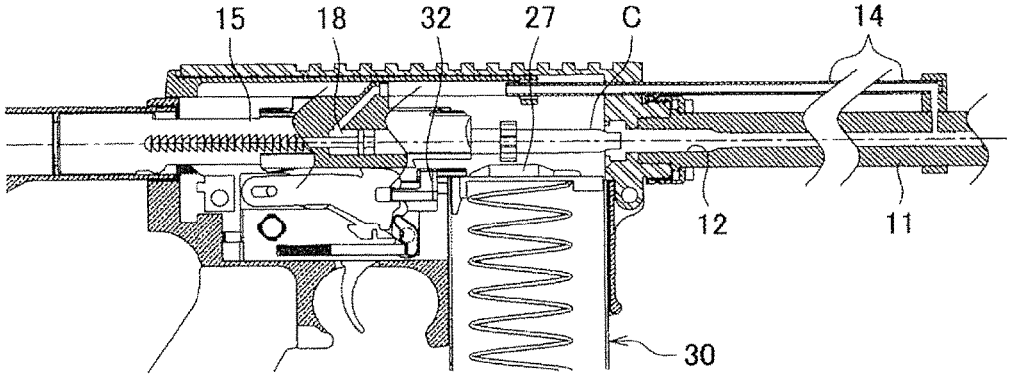

With regard to the bolt stop buffer device in the gun according to the present invention configured in this way, FIG. 3A illustrates a state before the last bullet (ball cartridge) is finally shot in the bullet loading unit 12. If the bullet B is shot by operating a trigger 25, the barrel is fully filled with gas generated by the bullet shooting, and the pressure flows from the gas tube 14 into the bore 18 of the bolt carrier 15. The bolt carrier 15 is moved rearward, thereby performing a so-called discharge operation in which the bolt spring 24 is compressed and the cartridge C is pulled out from the bullet loading chamber 12 (FIG. 3B).

If there is no more bullet (ball cartridge) in the magazine 30, the bolt carrier 15 moves rearward to the maximum rearward movement position (FIG. 4A). In the magazine 30, the resilient force the follower spring 28 causes the follower 27 to be pressed up to the empty space 29 near the rear portion of the bullet loading unit 12, and the follower 27 reaches the highest position. As the follower 27 rises, a pressing-up force acts on the relay member 32 engaging with the rear end portion 27*a* of the follower 27 in one end portion 32*a*.

The relay member 32 engages with the bolt stop 31 in the other end portion 32*b* and the groove portion 31*a*. If the rising of the follower 27 is transmitted, the bolt stop 31 is rotated around the shaft 34, and is rotated counterclockwise in FIG. 4A. As a result, the engagement pair portion 31*c* located in the upper portion of the bolt stop 31 protrudes into the track X.

After the bolt carrier 15 moves rearward to the maximum rearward movement position, the bolt carrier 15 is caused to move forward by a released accumulation force of the bolt spring 24. The engagement portion 15*a* disposed as one engagement means 36 in the bolt carrier 15 engages with the engagement pair portion 31*c* disposed in the above-described bolt stop 31 as the other engagement means 36 (FIG. 4B).

Figure 5A:
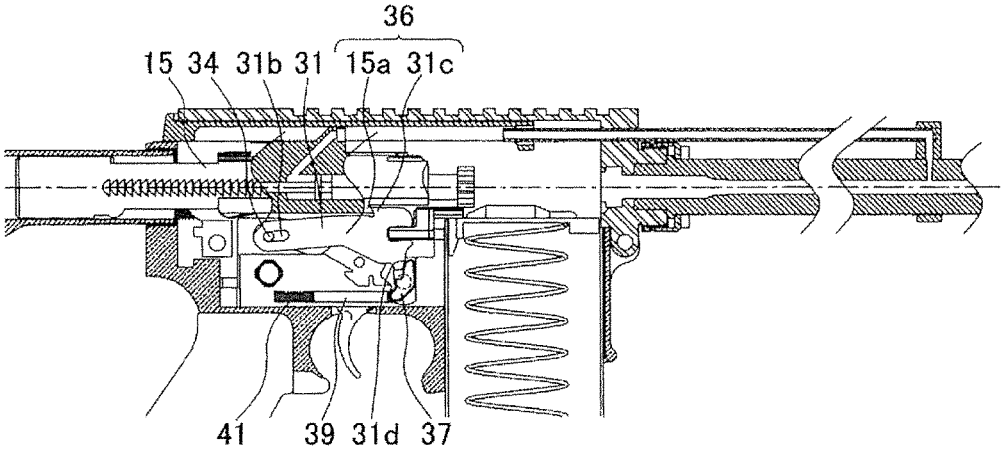
FIG. 5A and FIG. 5B relate to an operation of the device.

If the bolt carrier 15 further moves forward, the bolt stop 31 is carried forward by the engagement means 36. Accordingly, the position of the shaft 34 is changed so as to relatively move from the front end to the rear end of the long hole 31*b* (FIG. 5A). While the bolt stop 31 moves as described above, the bolt stop 31 presses the buffer link 37 engaging with the front engagement portion 31*d* against one end portion, and the other end portion presses the tip portion of the buffer shaft 39 engaging therewith against the elastic force of the buffer spring 41. Therefore, the impact applied by the bolt stop 31 moving in the gunpoint direction is absorbed by the buffer means 40 during the collision caused by the forward movement of the bolt carrier 15, and the bolt carrier 15 is gently stopped.

Figure 5B:
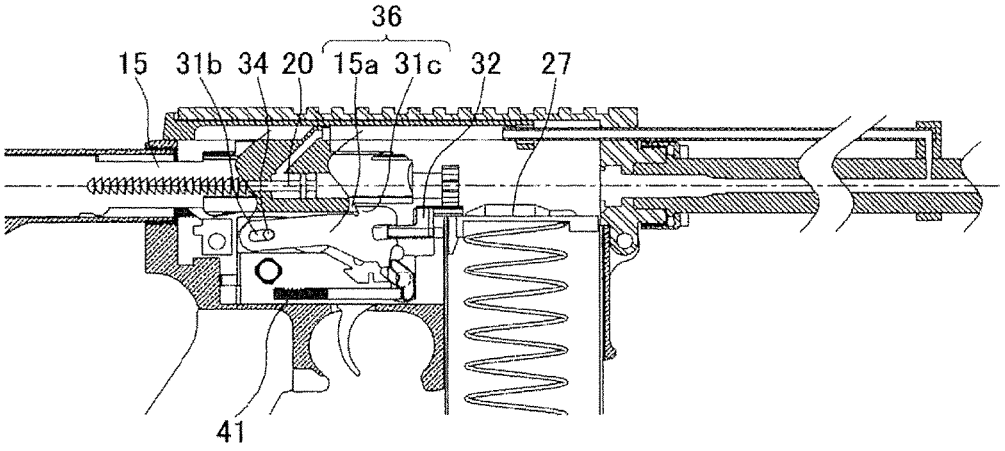

Subsequently, the bolt stop 31 is pressed rearward by the elastic force of the buffer spring 41, and the bolt carrier 15 also moves rearward to the position in FIG. 4B, thereby completing the operation of the buffer device (FIG. 5B). Furthermore, a magazine attachment/detachment device is operated so as to replace the magazine. The operation unit 32*d* of the relay member 32 is pressed or the bolt carrier 15 is moved rearward using a charging handle (not illustrated). In this manner, the front portion of the bolt stop 31 is lowered, and the engagement means 36 is disengaged. As a result, the bullet (ball cartridge) is reloaded, and the gun chamber is brought into a closed state.

In the bolt stop buffer device in the gun according to the present invention, the bolt stop 31 which stops the bolt carrier 15 is indirectly buffered by the buffer means 40, and the damage is prevented. In this manner, the gun can be protected so that sudden malfunction does not occur. In addition, the device according to the present invention maintains a function to detect the bullet absence indicating that the bullets B are all shot, and to replace and reload the magazine.

The operation of the bolt stop buffer device according to the present invention is performed as described above. Even in a case of general guns such as the assault rifle, the bullet is reloaded by replacing the magazine, and the bolt carrier 15 is operated by operating a handle (not illustrated). In this manner, the bullet is loaded, and the gun chamber is closed. Accordingly, there is no difference between the general guns and the gun to which the device according to the present invention is applied. Therefore, the device according to the present invention can be incorporated into the existing guns, and thus, it is possible to buffer the impact of the bolt when the gun is operated.

The invention claimed is:

1. A bolt stop buffer device in a gun comprising:

a bolt member that is disposed in a gun body and moves forward and rearward, wherein the bolt member moves rearward in response to a gas pressure generated by a bullet shooting so as to compress a bolt spring, and the bolt member moves forward in response to release of the compressed pressure so as to perform a bullet loading operation; and a bolt stop that stops forward movement of the bolt member, wherein the bolt stop buffer device in a gun comprises an engagement portion and an engagement pair portion for engaging with the bolt member which moves forward to reach the engagement portion and the engagement pair portion after a last bullet shooting, and wherein the bolt stop buffer device in a gun further comprises a buffer mechanism, and the buffer mechanism buffers an impact force applied to the bolt stop due to the engagement so as to act on the bolt stop, wherein a bullet absence detector is disposed in the gun body and detects an absence of a bullet to be supplied to a bullet loading chamber, wherein the bolt stop moves upward in response to a detection of the absence of the bullet to be supplied to the bullet loading chamber, which causes an engagement between the engagement portion and the engagement pair portion, wherein the buffer mechanism buffers an impact force applied when the bolt member moves forward.

2. The bolt stop buffer device in a gun according to claim 1, wherein the bullet absence detector includes a follower and a relay member for engaging the engagement portion and the engagement pair portion by causing the bolt stop to protrude into a track when the bolt member moves forward and rearward.

3. The bolt stop buffer device in a gun according to claim 1, wherein the bolt stop includes a bolt stop mechanism that receives an impact of the bolt member which moves forward to reach the bolt stop mechanism and transmits the impact to the buffer mechanism, between the bolt member and the buffer mechanism, and wherein the buffer mechanism includes an elastic member that is a buffer spring and elastically deformed by the transmitted impact.

4. The bolt stop buffer device in a gun according to claim 3, wherein a long hole is formed on the bolt stop in a forward-rearward direction, a shaft is disposed on the gun body side and relatively moves from a front end to a rear end of the long hole, and the bolt stop moves in a range of the long hole and is rotatable around the shaft.

5. The bolt stop buffer device in a gun according to claim 1, wherein the engagement portion is disposed in the bolt member and the engagement pair portion is disposed in the bolt stop, and the engagement portion and the engagement pair portion configure an acute angle in a forward movement direction of the bolt member.

6. The bolt stop buffer device in a gun according to claim 2, wherein the engagement portion is disposed in the bolt member and the engagement pair portion is disposed in the bolt stop, and the engagement portion and the engagement pair portion configure an acute angle in a forward movement direction of the bolt member.

* * * * *